US006334041B1

(12) United States Patent
Oota

(10) Patent No.: US 6,334,041 B1
(45) Date of Patent: Dec. 25, 2001

(54) FIXING APPARATUS COMPRISING A CLEANING ROLLER HAVING A PARTICULAR SURFACE

(75) Inventor: Hiroshi Oota, Tokyo (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/515,858

(22) Filed: Feb. 29, 2000

(51) Int. Cl.[7] ..... G03G 15/20
(52) U.S. Cl. ..... 399/326; 399/327
(58) Field of Search ..... 399/326, 327; 219/216, 256.51, 256.52

(56) References Cited

U.S. PATENT DOCUMENTS 3,945,318 * 3/1976 Landsman ..... 101/467
4,949,130 * 8/1990 Torino ..... 399/327
5,678,153 * 10/1997 Okamoto et al. ..... 399/327

FOREIGN PATENT DOCUMENTS 2674692 7/1997 (JP) .

* cited by examiner

*Primary Examiner*—Quana M. Grainger
(74) *Attorney, Agent, or Firm*—Foley & Lardner

(57) ABSTRACT

A fixing apparatus comprises a fixing section for fixing a developer image on a medium to which a developer image has been transferred by passing the medium between heat and press rollers, a cleaning roller made of metal and having a surface subjected to etching processing at surface roughness of 0.4 to 3.2 $\mu$m, and contacted the press roller of the fixing section for cleaning a developer which has stuck to the press roller during fixing operation, and a coat layer coated on the surface of the cleaning roller by a developer or a part of a component of the developer and having layer thickness of 50 to 150 $\mu$m and surface roughness of 4.8 $\mu$m or less.

4 Claims, 2 Drawing Sheets

FIXING APPARATUS COMPRISING A CLEANING ROLLER HAVING A PARTICULAR SURFACE

BACKGROUND OF THE INVENTION

The present invention relates to a fixing apparatus for fixing an image transferred to a paper sheet, which is comprised in an electrophotographic copying machine, for example.

Several fixing apparatuses of this kind comprise a heat roller and a press roller which roll in contact with each other. A paper sheet onto which an image has been transferred is let pass between the heat and press rollers, thereby heating and press the paper sheet to fix the transferred image to the paper sheet.

When fixing this transferred image, dirt of toner or the like sticks to the surface of the press roller in some cases. Therefore, a cleaning roller made of metal is pressed into contact with the press roller, and dirt of the press roller is removed by this cleaning roller.

The surface of the metal-made cleaning roller described above is subjected to polish processing after molding. During the polish processing, oil or the like is applied to the surface of the cleaning roller. This oil is removed from the surface of the cleaning roller by ultrasonic washing.

However, in some cases, the oil cannot be sufficiently removed by the ultrasonic washing but oil partially remains on the surface of the cleaning roller.

If oil thus remains on the surface of the cleaning roller, the part cannot provide sufficient adhesive strength. Consequently, even if dirt is cleaned from the press roller, the dirt easily peels off from the cleaning roller. Therefore, sufficient cleaning performance cannot be attained, so a problem arises in that the cleaned dirt sticks to the press roller again from the cleaning roller and stains the paper sheet or falls off from the cleaning roller and stains the inside of the fixing apparatus.

Further, mixture of a part to which toner sticks and a part free from toner on the cleaning roller is a factor which accelerates cleaning defects and the problem becomes worse.

BRIEF SUMMARY OF THE INVENTION

The present invention has been made in view of the above situation and has an object of providing a fixing apparatus and an image forming apparatus which are capable of attaining excellent cleaning performance without allowing dirt once cleaned to peel off from the cleaning roller.

A fixing apparatus according to the present invention comprises: fixing means for fixing a developer image on a medium, to which the developer image has been transferred, by passing the medium between a heat roller and a press roller, and a cleaning roller made of metal and having a surface subjected to etching processing at surface roughness of 0.4 to 3.2 $\mu$m, and contacted the press roller of the fixing means, for cleaning a developer which has stuck to the press roller during fixing of the developer image.

Another fixing apparatus according to the present invention comprises: fixing means for fixing a developer image on a medium, to which the developer image has been transferred, by passing the medium between a heat roller and a press roller, a cleaning roller made of metal and having a surface subjected to etching processing at surface roughness of 0.4 to 3.2 $\mu$m, and contacted the press roller of the fixing means, for cleaning a developer which has stuck to the press roller during fixing of the developer image; and a coat layer coated on the surface of the cleaning roller by a developer or a part of a component of the developer and having layer thickness of 50 to 150 $\mu$m and surface roughness of 4.8 $\mu$m or less.

Further, another fixing apparatus according to the present invention comprises: fixing means for fixing a developer image on a medium, to which the developer image has been transferred, by passing the medium between a heat roller and a press roller, and a cleaning roller made of metal and having a surface subjected to sandblast processing at surface roughness of 0.8 to 2.4 $\mu$m, and contacted the press roller of the fixing means, for cleaning a developer which has stuck to the press roller during fixing of the developer image.

An image forming apparatus according to the present invention comprises: image forming means for forming a electrostatic latent image corresponding to image information on an image carrier; developing means for supplying a developer to the electrostatic latent image formed by the image forming means, thereby to develop the electrostatic latent image; transfer means for transferring a developer image developed by the developing means, to a medium; and fixing means for fixing the developer image transferred by the transfer means, to the medium, wherein the fixing means includes heat and press rollers for fixing the developer image on the medium, to which the developer image has been transferred, by passing the medium between the heat and press rollers, and a cleaning roller made of metal and having a surface subjected to etching processing at surface roughness of 0.4 to 3.2 $\mu$m, and contacted the press roller of the fixing means, for cleaning the developer which has stuck to the press roller during fixing of the developer image.

Another image forming apparatus according to the present invention comprises: image forming means for forming a electrostatic latent image corresponding to image information on an image carrier; developing means for supplying a developer to the electrostatic latent image formed by the image forming means, thereby to develop the electrostatic latent image; transfer means for transferring a developer image developed by the developing means, to a medium; and fixing means for fixing the developer image transferred by the transfer means, to the medium, wherein the fixing means includes heat and press rollers for fixing the developer image on the medium, to which the developer image has been transferred, by passing the medium between the heat and press rollers, a cleaning roller made of metal and having a surface subjected to etching processing at surface roughness of 0.4 to 3.2 $\mu$m, and contacted the press roller of the fixing means, for cleaning the developer which has stuck to the press roller during fixing of the developer image, and a coat layer coated on the surface of the cleaning roller by a developer or a part of a component of the developer and having layer thickness of 50 to 150 $\mu$m and surface roughness of 4.8 $\mu$m or less.

Further another image forming apparatus according to the present invention comprises: image forming means for forming a electrostatic latent image corresponding to image information on an image carrier; developing means for supplying a developer to the electrostatic latent image formed by the image forming means, thereby to develop the electrostatic latent image; transfer means for transferring a developer image developed by the developing means, to a medium; and fixing means for fixing the developer image transferred by the transfer means, to the medium, wherein the fixing means includes heat and press rollers for fixing the developer image on the medium, to which the developer image has been transferred, by passing the medium pass between the heat and press rollers, thereby to fix the developer image, and a cleaning roller made of metal and having a surface subjected to sandblast processing at surface roughness of 0.8 to 3.2 μm, and contacted the press roller of the fixing means, for cleaning the developer which has stuck to the press roller during fixing of the developer image.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinafter.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

DETAILED DESCRIPTION OF THE INVENTION

Figure 1:
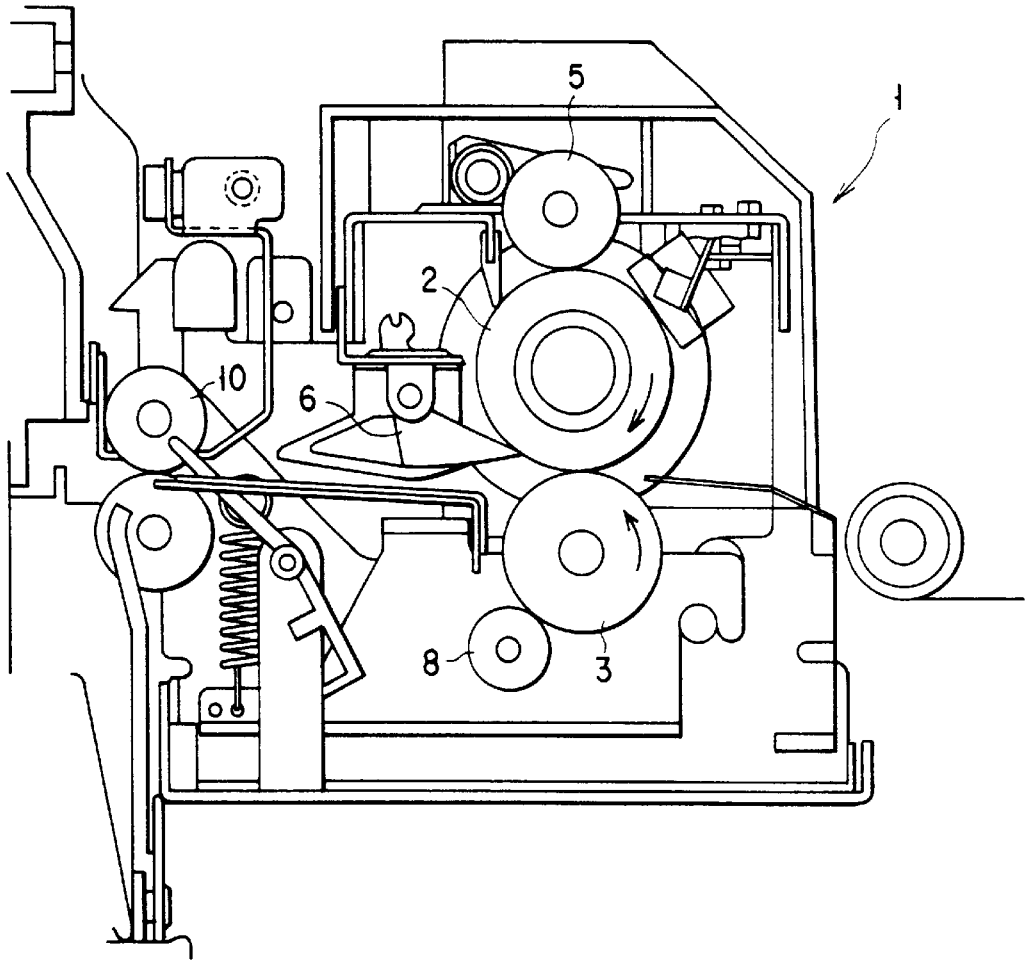
FIG. 1 is a schematic structural view showing a fixing apparatus as an embodiment of the present invention.

The present invention will now be explained below with reference to an embodiment shown in the drawings.

FIG. 1 is a structural view showing a fixing apparatus 1.

The fixing apparatus 1 comprises a heat roller 2 and a press roller 3 pressed in contact with the lower surface part of the heat roller 2.

The heat roller 2 is constructed by coating fluorine resin to be 25 μm thick on the surface of an aluminum raw tube. The aluminum raw tube is a tube member of ϕ60 mm and thickness of 8 mm. The aluminum raw tube is an inverted crown and has a crown amount of 180 μm.

The press roller 3 is of ϕ60 mm and has rubber thickness of 5 mm. The press roller has hardness of 45° (JIS-A), and a fluorine resin tube is coated on the surface thereof. The total load of the press roller 3 is 900 N and the temperature of the heat roller 2 is controlled at 200° C. The heat roller 2 and the press roller 3 are rotated at a circumferential speed of 400 to 450 mm/S.

Also, a peeling nail 6 for peeling a paper sheet from the cleaning roller 5 is set in contact with the heat roller 2, and a metal-made cleaning roller 8 is set in contact with the press roller 3.

The cleaning roller 5 of the heat roller 2 is of ϕ28 and is comprised of a silicon oil tank of ϕ24 and a heat-resistant felt material having thickness of 2 mm. The silicon oil tank contains a silicon oil of 70 g having viscosity of 30,000 CS, and the heat-resistant felt material soaks a silicon oil of 10 g.

The metal-made cleaning roller 8 of the press roller is an aluminum roller of ϕ28 and is subjected to integral molding or hollow molding. The cleaning roller 5 reversely rotates at an equal speed with respect to the heat roller 2, and the metal-made cleaning roller 8 rotates at an equal speed as a slave of the press roller 3.

Explained next will be fixing operation.

A paper sheet onto which a toner image has been transferred by an image transfer section not shown is fed between the heat roller 2 and the press roller 3. The paper sheet is thereby heated and pressed by the press roller 3 so that a toner image is fixed to the paper sheet. The paper sheet to which the toner image has been fixed is peeled off and fed from the heat roller 2 by the peeling nail 6 and is fed out by paired feed-out rollers 10.

During this fixing, in some cases, a stain of toner or the like sticks to the heat roller 2 and then sticks to the press roller 3 from the heat roller 2, so the press roller 3 becomes dirty. The dirt sticks to the press roller 3 sticking to the press roller 3 is removed and cleaned by the cleaning roller 8.

Any of various types of rollers can be used as the metal-made cleaning roller 8 of the press roller 3.

That is, it is possible to use a cleaning roller 8 whose surface is subjected to etching processing (hereinafter called a first metal roller 8A), a cleaning roller 8 having a surface on which a developer or resin thereof is coated and the coating layer is calcined (hereinafter called a second metal roller 8B), or a cleaning roller 8 whose surface is subjected to sandblast processing (hereinafter called a third metal roller).

A conventional cleaning roller which is subjected only to ultrasonic washing after mechanical polishing on its surface will be called simply a metal roller.

Next, with reference to the tables 1 to 3, explanation will be made of results of paper tests carried out in a copying machine of 45 to 65 cpm/A4 while changing the type of metal roller, the surface roughness, and the thickness of the coating layer.

In the columns of "initial shortage of cleaning", the mark ○ expresses a level at which dirt of a cleaned press roller is almost collected without problems. The mark Δ expresses a level at which a part of dirt cannot be collected from a cleaned press roller but sticks again to the press roller although a problem is not directly caused. The mark × expresses a level at which cleaned dirt cannot be collected but sticks to the press roller, causing a problem.

Also, in the columns of "press roller abrasion", the mark ○ expresses a level at which no problem occurs although a small abrasion appears on the surface of the press roller. The mark Δ expresses a level at which noticeable abrasions appear on the surface and can cause a problem. The mark × expresses a level at which the surface property is degraded by abrasions and a problem occurs.

TABLE 1

| | CONDITION 1 | CONDITION 2 | CONDITION 3 | CONDITION 4 |
|---|---|---|---|---|
| CONDITION OF METAL ROLLER, PERFORMANCE | ULTRASONIC WASHING AFTER SURFACE | SURFACE ETCHING PROCESSING | SURFACE ETCHING PROCESSING + RESIN COATING | SURFACE SANDBLAST PROCESSING |

TABLE 1-continued

| | CONDITION 1 | CONDITION 2 | CONDITION 3 | CONDITION 4 |
|---|---|---|---|---|
| | POLISHING | | | |
| SURFACE ROUGHNESS | 0.4 to 3.2 μm | 0.4 to 3.2 μm | 0.4 μm or less | 0.8 to 3.2 μm |
| PRESENCE OR ABSENCE OF STICKING TONER | 4–6/20 | 0/20 | 0/20 | 0/20 |
| INITIAL SHORTAGE OF CLEANING | Δ–x | Δ | ○ | ○ |
| LIFE PERFORMANCE (NUMBER OF SHEETS TILL PROBLEM OCCURS) | 150 to 400k sheets | 300 to 400k sheets | 400k sheets | 400k sheets |
| REMARKS | — | — | excellent at coating thickness 50 to 150 μm | — |

20

TABLE 2

| CONDITION 3 RESIN | CONDITION 3-2-4 | CONDITION 3-1 | CONDITION 3-2 | CONDITION 3-3 | CONDITION 3-4 | CONDITION 3-5 |
|---|---|---|---|---|---|---|
| METAL ROLLER CONDITION, PERFORMANCE | SURFACE ETCHING PROCESSING + RESIN COATING | ← RESIN COATING THICKNESS 25 μm | ← RESIN COATING THICKNESS 50 μm | ← RESIN COATING THICKNESS 100 μm | ← RESIN COATING THICKNESS 150 μm | ← RESIN COATING THICKNESS 200 μm |
| SURFACE ROUGHNESS (Ra) | 4.8 μm or less (after resin coating) | ← | ← | ← | ← | ← |
| PRESENCE OR ABSENCE OF PEELING OF STICKING TONER | 0/20 | 0/20 | 0/20 | 0/20 | 0/20 | 0/20 |
| INITIAL SHORTAGE OF CLEANING | ○ | Δ–x | ○ | ○ | ○ | ○ |
| LIFE PERFORMANCE (NUMBER OF SHEETS TILL PROBLEM OCCURS) | 400k sheets | 150 to 400k sheets | 400k sheets | 400k sheets | 400k sheets | 300 to 400k sheets |
| REMARKS | excellent at coating thickness 50 to 150 μm | — | — | — | — | — |

TABLE 3

| | | SURFACE ROUGHNESS OF METAL ROLLER Ra (μm) | | | | | | |
|---|---|---|---|---|---|---|---|---|
| PERFORMANCE OF METAL ROLLER | | 0.2 | 0.4 | 0.8 | 1.6 | 3.2 | 4.8 | 6.3 |
| SANDBLAST PROCESSING | PRESENCE OR ABSENCE OF PEELING OF STICKING TONER | 2/20 | 0/20 | 0/20 | 0/20 | 0/20 | 0/20 | 0/20 |
| | INITIAL SHORTAGE OF CLEANING | Δ–x | Δ | ○ | ○ | ○ | ○ | Δ |
| | ABRASION OF PRESS ROLLER (FLUORINE RESIN) | ○ | ○ | ○ | ○ | ○ | Δ | x |
| | LIFE PERFORMANCE (NUMBER OF SHEETS TILL PROBLEM OCCURS) (× K sheets) | 150 to 400 | 300 to 400 | 400 | 400 | 400 | 200 to 300 | 200 |
| ETCHING (CAUSTIC) PROCESSING | PRESENCE OR ABSENCE OF PEELING OF STICKING TONER | 3/20 | 0/20 | 0/20 | 0/20 | 0/20 | 0/20 | 0/20 |
| | INITIAL SHORTAGE OF CLEANING | Δ–x | Δ | Δ | Δ | Δ | Δ | Δ–x |
| | ABRASION OF PRESS ROLLER | ○ | ○ | ○ | ○ | ○ | Δ | x |

TABLE 3-continued

| PERFORMANCE OF METAL ROLLER | | SURFACE ROUGHNESS OF METAL ROLLER Ra (μm) 0.2 | 0.4 | 0.8 | 1.6 | 3.2 | 4.8 | 6.3 |
|---|---|---|---|---|---|---|---|---|
| | (FLUORINE RESIN) | | | | | | | |
| | LIFE PERFORMANCE (NUMBER OF SHEETS TILL PROBLEM OCCURS) (× K sheets) | 150 to 400 | 300 to 400 | 300 to 400 | 300 to 400 | 300 to 400 | 200 to 300 | 200 |
| ULTRASONIC WASHING AFTER MECHANICAL POLISHING | PRESENCE OR ABSENCE OF PEELING OF STICKING TONER | 8/20 | 6/20 | 5/20 | 4/20 | 5/20 | 4/20 | 5/20 |
| | INITIAL SHORTAGE OF CLEANING | x | Δ–x | Δ–x | Δ–x | Δ–x | Δ–x | x |
| | ABRASION OF PRESS ROLLER (FLUORINE RESIN) | ○ | ○ | ○ | ○ | ○ | Δ | x |
| | LIFE PERFORMANCE (NUMBER OF SHEETS TILL PROBLEM OCCURS) (× K sheets) | 100 to 300 | 150 to 400 | 150 to 400 | 150 to 400 | 150 to 400 | 150 to 300 | 150 to 200 |
| ULTRASONIC WASHING AFTER CENTERLESS POLISHING | PRESENCE OR ABSENCE OF PEELING OF STICKING TONER | 8/20 | 6/20 | 4/20 | 5/20 | 5/20 | 5/20 | 5/20 |
| | INITIAL SHORTAGE OF CLEANING | x | Δ–x | Δ–x | Δ–x | Δ–x | Δ–x | x |
| | ABRASION OF PRESS ROLLER (FLUORINE RESIN) | ○ | ○ | ○ | ○ | ○ | Δ | x |
| | LIFE PERFORMANCE (NUMBER OF SHEETS TILL PROBLEM OCCURS) (× K sheets) | 100 to 300 | 150 to 400 | 150 to 400 | 150 to 400 | 150 to 400 | 150 to 300 | 150 to 200 |

At first, explanation will be made of a conventional case of using a metal roller subjected only to ultrasonic washing after mechanical surface polishing. The surface roughness (Ra) of the metal roller is 0.4 to 3.2 μm.

In this case, dirt of toner or the like peels from the metal roller at a ratio of four to six samples per twenty samples. The dirt which has thus peeled sticks again to the press roller 3 thereby causing image dirt or scatters in the fixing apparatus thereby causing dirt.

This is because degreasing of the polishing surface of the metal roller cannot be achieved sufficiently and oil used in formation of the metal roller remains. In this case, the adhesive strength of the metal roller is not sufficient and cleaned dirt peels from the metal roller, so sufficient cleaning performance cannot be attained and the lifetime continues for fixing of 150 to 400K paper sheets.

As shown in the Table 3, even in case of a metal roller subjected to ultrasonic washing after centerless polishing, it is impossible to attain sufficient cleaning performance like in the case of the above-described metal roller subjected to ultrasonic washing after mechanical surface polishing.

Next explanation will be made of a case of using a first metal roller 8A obtained by performing etching processing at surface roughness (Ra) of 0.4 to 3.2 μm on the surface of the metal-made cleaning roller 8.

In this case, since dirt of oil during formation of the metal roller can be completely removed, a phenomenon that dirt of toner or the like sticking to the first metal roller 8A peels off does not occur during cleaning.

However, in an initial stage of cleaning, the adhesive strength to the press roller 3 is somehow weak before a toner layer is formed on the surface of the first metal roller 8A due to sticking of toner. Therefore, a small amount of dirt remains on the surface of the press roller 3 in some cases.

In this case, a problem does not appear soon but the cleaning performance is slightly deteriorated due to the dirt which remains during the initial stage of cleaning, so the lifetime continues for fixing of 300 to 400 paper sheets.

Explained next will be a case of using a second metal roller 8B obtained by performing etching processing on the surface of a metal-made cleaning roller 8 and by coating a developer or resin thereof on the surface thereof to form a coating layer whose surface roughness (Ra) is set to 4.8 μm or less.

The following relationship exists between the thickness of the coating layer of the second metal roller 8B and the cleaning performance thereof.

That is, as shown in the Table 2, if the thickness of the coating layer is 25 μm or less, the adhesive strength between the coating layer and the metal roller 8 is not yet sufficient. The coating layer therefore peels in some cases, so sufficient cleaning performance cannot be expected and the lifetime continues for fixing of 150 to 400K paper sheets.

In case where the thickness of the second metal roller 8B is 50 to 150 μm, the adhesive strength of the surface of the metal roller 8 as a coating layer is sufficient, so the coating layer does not peel with respect to all samples until 400 paper sheets are subjected to fixing and sufficient cleaning performance can be attained.

Also, if the thickness of the coating layer of the second metal roller 8B is 200 μm or more, the adhesive strength of the coating layer is sufficient, and the number of paper sheets subjected to fixing until dirt on the surface of the metal roller 15 is saturated decreases in correspondence with the coating layer. Therefore, if the coating layer is 200 μm thick, cleaning cannot be achieved any more and sufficient cleaning performance cannot be expected after 300 to 400 paper sheets are subjected to fixing.

Accordingly, in the present embodiment, sufficient cleaning performance can be attained by setting the thickness of the coating layer of the second metal roller 8B to 50 to 150 μm.

Next, explanation will be made of a case of using a third metal roller 8C obtained by performing sandblast processing on the surface of a metal-made cleaning roller 8, i.e., subjecting the surface to processing for forming a plurality of continuous projections.

In this case, it is possible to obtain cleaning performance equal to that of the second metal roller 8B. In this sandblast processing, excellent cleaning performance can be attained at surface roughness (Ra) of 0.8 to 3.2 μm.

However, if the surface roughness (Ra) of the third metal roller 8C is 0.4 μm or less, projections on the surface are small, so the surface area is small and sufficient adhesive strength cannot be attained at an initial stage of cleaning. Therefore, cleaned dirt sticks again to the press roller 3 and the like and thereby results in defective cleaning.

Inversely, if the surface roughness (Ra) of the third metal roller 8C is 4.8 or more, the projections are large and therefore damage the surface of the press roller 3, so the lifetime of the press roller is shortened.

Therefore, in the present embodiment, cleaning performance equal to that obtained in case of using the second metal roller 8B can be attained by setting the surface roughness (Ra) of the third metal roller 8C to 0.8 to 3.2 μm.

Also, this third metal roller 8C is advantageous in that the number of work steps during manufacture thereof can be reduced in comparison with the second roller 8B, so costs can be reduced.

As described above, in the present invention, since the surface of the cleaning roller 8 of the press roller 3 of the fixing apparatus is subjected to etching processing at surface roughness (Ra) of 0.4 to 3.2 μm, sufficient adhesive strength can be obtained. Accordingly, dirt of toner or the like which has once been cleaned is prevented from peeling off, so excellent cleaning performance can be obtained and dirt of paper sheets or dirt inside the fixing apparatus can be prevented for a long period.

In addition, the surface of the metal roller is subjected to etching processing, and a coating layer of toner or toner resin is formed on the surface thus subjected to etching processing. The coating layer is set to be 50 to 150 μm thick, and the surface roughness (Ra) is set to 4.8 or less. It is therefore possible to attain more stable and excellent cleaning performance which provides sufficient adhesive strength from the initial stage of cleaning.

Further, the surface of the metal roller is subjected to sandblast processing, and the surface roughness (Ra) thereof is set to 0.8 to 3.2 μm. It is therefore possible to attain stable and excellent cleaning performance which provides sufficient adhesive strength from the initial stage of cleaning and to reduce the number of steps necessary for surface processing, so costs can be reduced.

Figure 2:
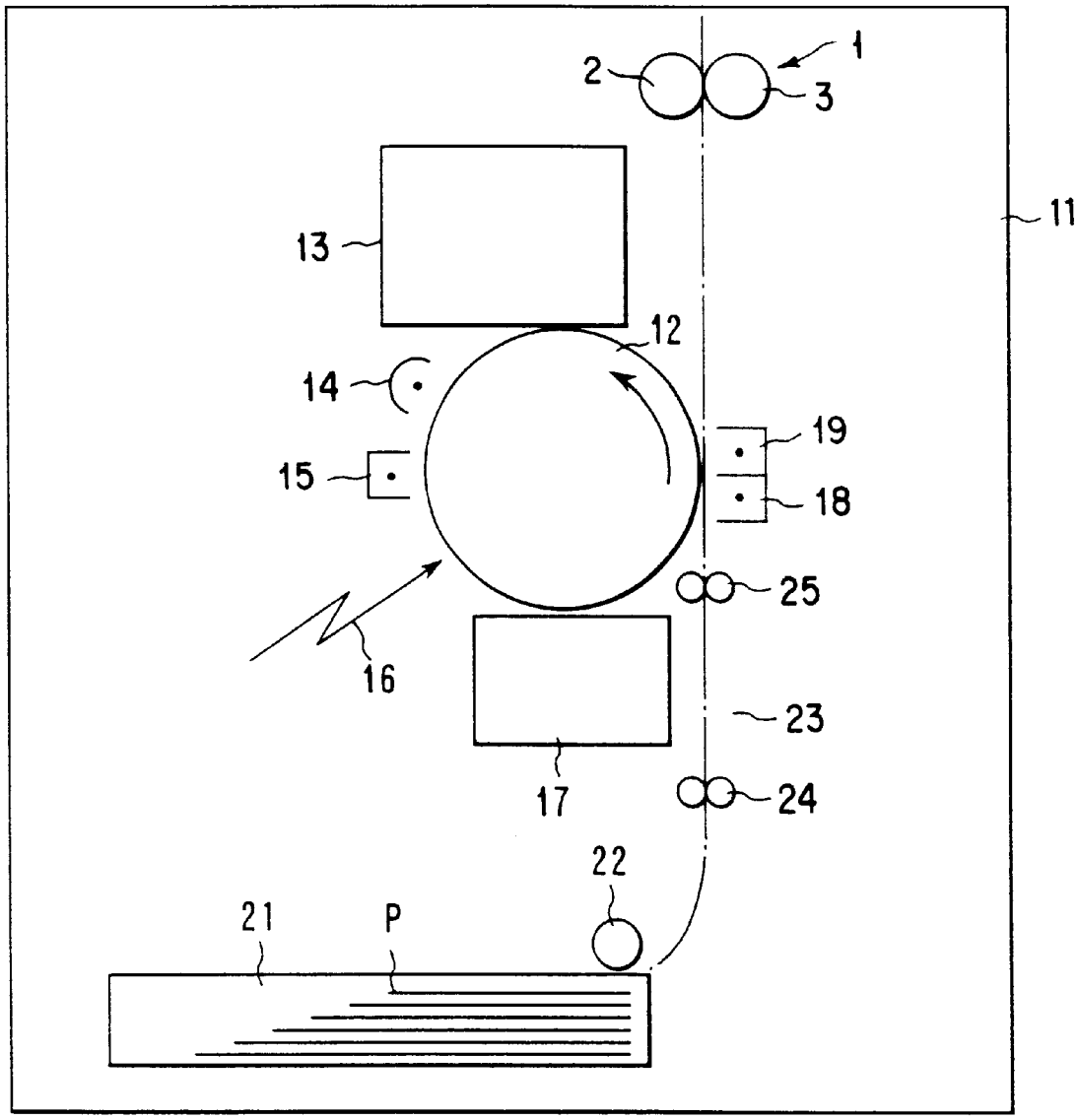
FIG. 2 is a schematic structural view showing an image forming apparatus comprising the fixing apparatus shown in FIG. 1.

FIG. 2 shows a copying machine as an image forming apparatus comprising the fixing apparatus 1 described above.

In the figure, the reference 11 denotes a copying machine body and a photosensitive drum 12 as an image carrier is provided rotatably at the center portion of this copying machine body. A cleaning device 13 for removing magnetic toner which remains on the photosensitive drum 12 is provided, facing to an upper surface part of the photosensitive drum 12. Therefore, dirt once cleaned sticks again to the press roller 3 or the like thereby causing defective cleaning.

At a side part of the photosensitive drum 12, a discharger 14 for discharging the surface potential of the photosensitive drum 12, an electrification charger 15 for charging the surface of the photosensitive drum 12 to a predetermined potential, and an exposure section 16 for forming a toner image corresponding to an original image are provided, facing thereto. At a lower surface part of the photosensitive drum 12, a developing device 17 for supplying magnetic toner as a developer to a toner image on the photosensitive drum 12 is provided facing thereto. At another side part of the photosensitive drum 12, a transfer charger 18 for transferring the toner image to a paper sheet, and a peeling charger 19 for peeling the paper sheet on which the toner image has been transferred, from the photosensitive drum 12 are provided facing thereto.

A sheet feed cassette 21 which contains paper sheets P is provided in the lower side in the copying machine body 11. A sheet feed roller 22 is provided at a side upper part of the sheet feed cassette 21. A paper sheet P fed from the sheet feed roller 22 is conveyed through a convey path 23. On the convey path 23, there are provided a paired convey rollers 24, paired resist rollers 25 for aligning the paper sheet P, the transfer and peeling chargers 18 and 19 described above, and a fixing apparatus 27 for fixing a toner image, which has been transferred to the paper sheet P, to the paper sheet P.

During image formation, the surface of the photosensitive drum 12 is charged by the electrification charger 15, and an electrostatic latent image is formed on the charged surface of the photosensitive drum 12 by the exposure section 16. This electrostatic latent image is fed to the developing device 17 as the photosensitive drum 12 rotates, and magnetic toner as a developer is supplied from the developing device 17 thereby to form a magnetic toner image.

At this time, the paper sheet P is fed as the sheet feed roller 22 rotates. This paper sheet P is conveyed clamped between the paired convey rollers 24. The paper sheet P is aligned by the paired resist rollers 25 and is thereafter fed between the photosensitive drum 12 and the transfer charger 18, where a magnetic toner image on the photosensitive drum 12 is transferred onto the paper sheet P. The paper sheet P to which the magnetic toner image has been transferred is peeled and conveyed from the photosensitive drum 12 due to the effect of the peeling charger 19. This paper sheet P is fed to the fixing apparatus 1 described above where the transferred toner image is fixed to the paper sheet P and is discharged to a discharge section not shown.

Additional advantages and modifications will readily occur to those skilled in the art. Therefore, the invention in its broader aspects is not limited to the specific details and representative embodiments shown and described herein. Accordingly various modifications may be made without departing from the spirit or scope of the general inventive concept as defined by the appended claims and their equivalents.

What is claimed is:

1. A fixing apparatus comprising:

fixing means for fixing a developer image on a medium, to which the developer image has been transferred, by passing the medium between a heat roller and a press roller, a cleaning roller made of metal and having a surface subjected to etching processing at surface roughness of 0.4 to 3.2 μm, and contacted the press roller of the fixing means, for cleaning a developer which has stuck to the press roller during fixing of the developer image; and a coat layer coated on the surface of the cleaning roller by a developer or a part of a component of the developer and having layer thickness of 50 to 150 μm and surface roughness of 4.8 μm or less.

2. An apparatus according to claim 1, wherein the developer forming the coat layer is of the same kind as the developer forming the developer image.

3. An apparatus according to claim 1, wherein the cleaning roller is a solid or hollow roller made of aluminum and oil which has stuck to the cleaning roller during processing is removed by ultrasonic washing.

4. An image forming apparatus comprising:

image forming means for forming an electrostatic latent image corresponding to image information on an image carrier;

developing means for supplying a developer to the electrostatic latent image formed by the image forming means, thereby to develop the electrostatic latent image;

transfer means for transferring a developer image developed by the developing means, to a medium; and fixing means for fixing the developer image transferred by the transfer means, to the medium, wherein the fixing means includes heat and press rollers for fixing the developer image on the medium, to which the developer image has been transferred, by passing the medium between the heat and press rollers, a cleaning roller made of metal and having a surface subjected to etching processing at surface roughness of 0.4 to 3.2 $\mu$m, and contacted the press roller of the fixing means, for cleaning the developer which has stuck to the press roller during fixing of the developer image, and a coat layer coated on the surface of the cleaning roller by a developer or a part of a component of the developer and having layer thickness of 50 to 150 $\mu$m and surface roughness of 4.8 $\mu$m or less.

* * * * *